US005505234A

United States Patent [19]

Simpson et al.

[11] Patent Number: 5,505,234

[45] Date of Patent: Apr. 9, 1996

[54] ELECTRONIC TRIGGER ASSEMBLY FOR A FUEL DISPENSING NOZZLE

[75] Inventors: W. Dwain Simpson, Wilton; James H. Pyle, Weston, both of Conn.

[73] Assignee: Saber Equipment Corporation, Fairfield, Conn.

[21] Appl. No.: 275,987

[22] Filed: Jul. 15, 1994

[51] Int. Cl.[6] ..... B67D 5/372

[52] U.S. Cl. ..... 141/206; 141/208; 141/209; 141/217; 141/219

[58] Field of Search ..... 141/206–209, 141/217–219, 227

[56] References Cited

U.S. PATENT DOCUMENTS 2,918,095 12/1959 Shawhan ..... 141/219 X
3,380,491 4/1968 Rosell et al. ..... 141/219 X
5,131,441 7/1992 Simpson et al. ..... 141/209

*Primary Examiner*—J. Casimer Jacyna
*Attorney, Agent, or Firm*—Gottlieb, Rackman & Reisman

[57] ABSTRACT

An electronic fuel dispensing nozzle assembly adapted to reduce the undesirable effects of a pure mechanical system by providing an electromechanical fuel dispensing trigger assembly. An electromechanical fuel dispensing trigger assembly includes a valve assembly selectively displaceable between an open and a closed position and a trigger assembly selectively displaceable between a first position and a second position. Electronic elements are provided to selectively enable the trigger assembly to selectively open the valve when displaced from the first position to the second position. Furthermore, the electronic elements can also inhibit the trigger assembly, such that motion of the trigger assembly from the first position to the second position does not cause the valve assembly to be displaced from the closed position to the open position.

16 Claims, 7 Drawing Sheets

402
406
407
553
212
306
41
40
46
345
301
551
425
410
414a
426
421
424
414
50
412A

ELECTRONIC TRIGGER ASSEMBLY FOR A FUEL DISPENSING NOZZLE

BACKGROUND OF THE INVENTION

This invention is directed to an electronic trigger assembly for a fuel dispensing nozzle, and, in particular, to an electronic trigger assembly that includes electronic means for sensing pressure or fluid level in order to terminate fuel dispensation when the fluid level or pressure in the fuel tank reaches a predetermined value, and for terminating fuel dispensation when the trigger assembly is not at the appropriate angle for fuel dispensation.

The promulgation of government regulations regarding fuel vapor recovery, intrinsic safeness of electronic devices used in fuel dispensation and other regulations surrounding the fuel dispensation industry have caused modifications in fuel dispensing. In particular, many attempts have been made to develop electronic devices for use in fuel dispensing systems. None of these devices have heretofore been commercialized. This is due in part to the fact that the devices do not provide substantial advancement over prior art purely mechanical devices, and these devices require separate batteries with a finite energy supply to be periodically installed within the nozzle assembly.

Prior U.S. Pat. No. 5,267,592 issued on Dec. 4, 1993 and U.S. patent application Ser. No. 161,679 filed on Dec. 2, 1993 are directed to devices for transmitting intrinsically safe electric power from the fuel dispenser through the dispensing hose to the nozzle assembly. The inventions embodied in the above-noted patent and patent application make the invention of the present application possible and are hereby incorporated by reference.

Although electronic devices used in fuel dispensing nozzles have been suggested, none of the fuel dispensing systems heretofore known includes electronic pressure sensors or mercury switches that can electronically enable and disenable the flow of fluid through the dispensing nozzle. Furthermore, this allows the enabling switches to be aligned in series, such that if either switch is disenabled, the fuel dispensing function of the nozzle is inhibited.

SUMMARY OF THE INVENTION

Generally speaking, in accordance with the invention, an electronic trigger assembly for a fuel dispensing nozzle is described. The assembly is adapted to selectively dispense fuel when current is supplied to the trigger assembly and the electronic inhibit features are uninhibited. The electronic trigger assembly includes a valve assembly that is displaceable between an open position and a closed position. A trigger assembly is selectively displaceable between a first position and a second position. Electronic circuitry is provided to operate an electromechanical transducer for selectively enabling the trigger assembly to open the valve assembly when the trigger is displaced from the first position to the second position.

Furthermore, the electronic circuitry includes a mercury switch or other equivalent switch, so that the electronic circuitry is inhibited when the trigger assembly is not in the appropriate position for fuel dispensing; for example, when the nozzle is held upright, such that the spout is facing away from the ground.

Another object of this invention is to provide an electronic fuel dispensing nozzle assembly that uses a pressure switch to inhibit the trigger assembly.

Yet another object of the invention is to eliminate fuel spitting when the fluid level has reached a predetermined height in the gas tank, where no more fuel is desired to be dispensed.

Still another object of the invention is to provide an electronic fuel dispensing nozzle assembly that includes a plurality of means for inhibiting fuel flow connected in series, such that if any one of the conditions occurs, fuel dispensation is terminated.

Still other objects and advantages of the invention will in part be obvious and will in part be apparent from the specification.

The invention accordingly comprises the features of construction, combination of elements, and arrangement of parts which will be exemplified in the constructions hereinafter set forth and the scope of the invention will be indicated in the claims.

BRIEF DESCRIPTION OF THE PREFERRED EMBODIMENT

For a fuller understanding of the invention, reference is made to the following description taken in connection with the accompanying drawings, in which.

DETAILED DESCRIPTION OF THE PREFERRED EMBODIMENTS

Figure 1:
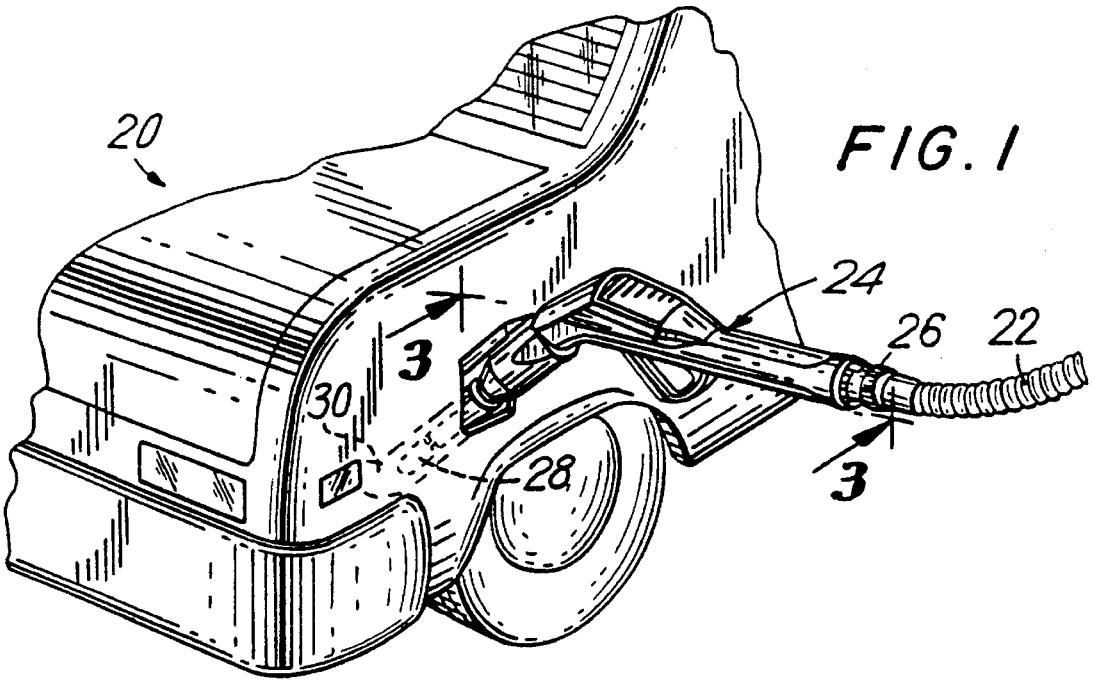
FIG. 1 is a perspective view of a fuel dispensing nozzle assembly within the fuel tank of an automobile.

Reference is now made to FIG. 1, which illustrates an automobile generally indicated at 20 for receiving gasoline from a gas pump (not shown). The gas pump is connected to a distribution hose 22 which in turn is connected to a nozzle assembly generally indicated as 24. Nozzle assembly 24 includes a receiving end 26 which is coupled to distribution hose 22 and a spout 28 opposite receiving end 26. Spout 28 is depicted within an inlet tube 30 (shown in phantom) of automobile 20. This is generally referred to as the fluid dispensing position.

Figure 2:
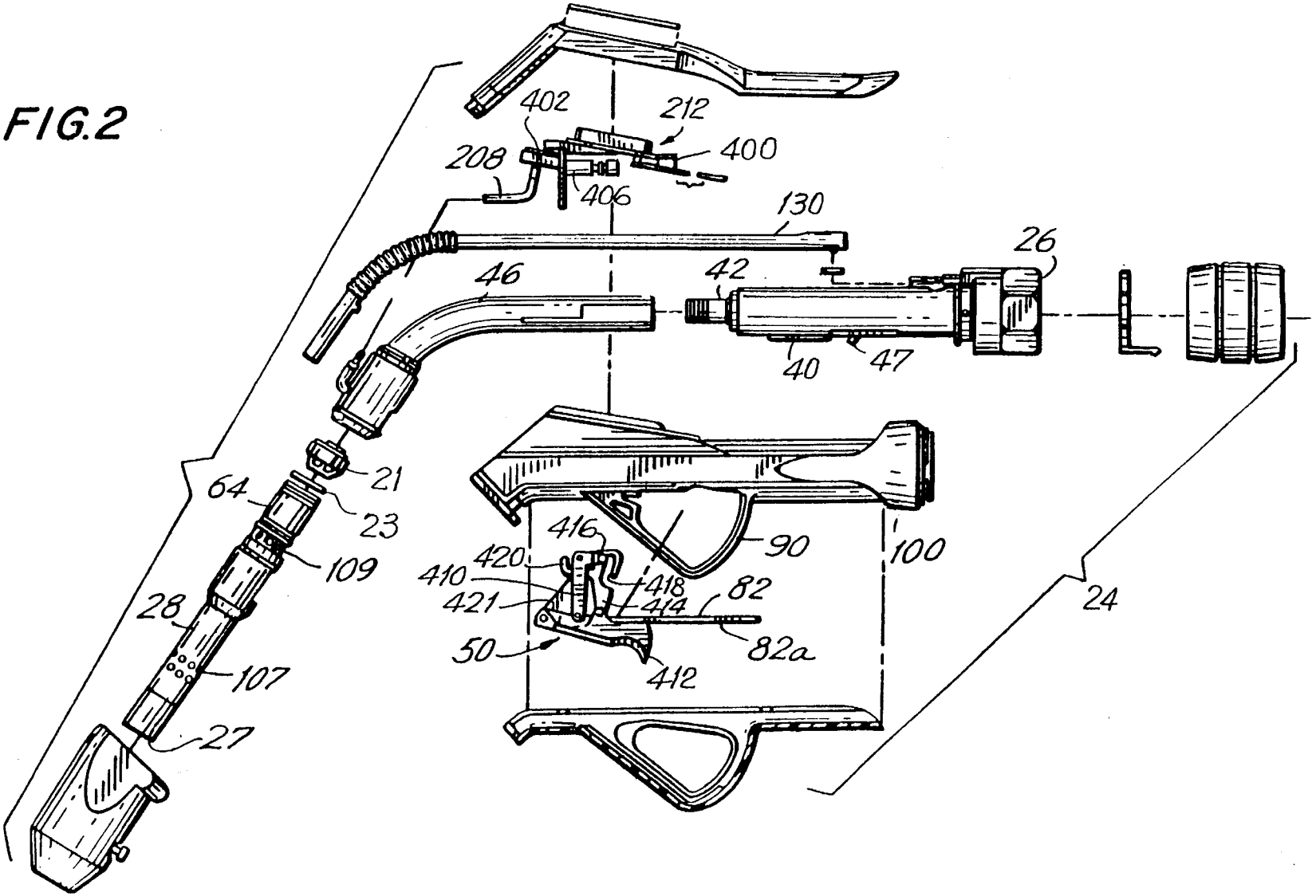
FIG. 2 is an exploded view of a fuel dispensing nozzle assembly formed in accordance with the first embodiment of the invention.

With reference to FIG. 2, there are generally three related functions being performed by nozzle assembly 24. Firstly, nozzle assembly 24 performs fluid dispensation, wherein fluid is received at receiving end 26 of nozzle assembly 24 and is dispensed at dispensing end 27 of spout 28. Secondly, nozzle assembly 24 senses the fluid level within the gas tank, such that when the fluid level rises to a predetermined point, fluid dispensation is automatically terminated. Thirdly, nozzle assembly 24 removes gasoline vapor from the gas tank of automobile 20. The vapor then travels through assembly 24 in a direction opposite fluid flow and is stored in a storage tank (not shown). The fluid dispensation and automatic cut-off are described in detail below.

Referring specifically to FIG. 2, nozzle assembly 24 is constructed with a housing, generally indicated at 100, which houses a trigger assembly, generally indicated at 50. Trigger assembly 50 operates a valve assembly 40 to allow fluid to flow therethrough. Fluid flows through valve assembly 40, flow tube 46 and spout 28. Vapor is collected through spout 28, vapor tube 130 and valve assembly 40. The fluid level in the gas tank is sensed to determine when the fluid has reached a predetermined level, so that fluid dispensation is automatically shut off. The automatic shut-off subsystem generally includes spout 28 having a conduit (not shown) travelling therethrough, a flexible hose 208, a circuit board 212, trigger assembly 50 and valve assembly 40.

Figure 3:
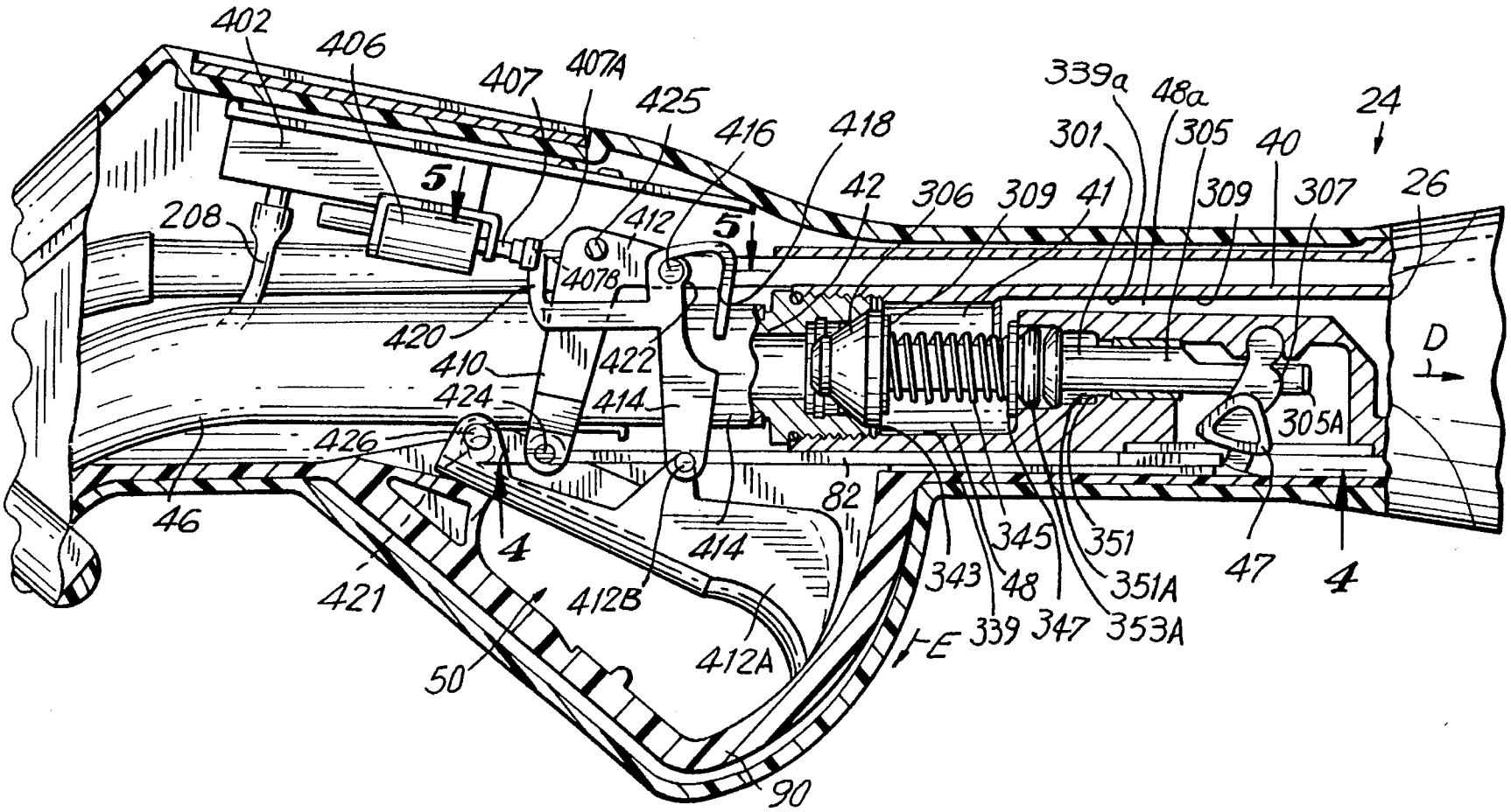
FIG. 3 is a fragmentary elevational view of the fuel dispensing nozzle of FIG. 2 with the housing cut away and the trigger in the at rest condition.

FIG. 3 partially illustrates the inner elements of valve assembly 40, which includes a receiving end 26 and a dispensing end 42. Receiving end 26 includes internal threads (not shown) for engaging the external threads (not shown) of distribution hose 22. Fuel enters receiving end 26 of valve assembly 40 and travels through flow path 41 in valve assembly 40.

Flow path 41 comprises an annular portion 48 and a semi-annular portion **48*a* which is defined by walls 339 and 339*a*. Fluid is prevented from leaving valve assembly 40 by a fluid impervious wall which is defined by the intersection of head 306 of plunger 301 and shoulder 343. Head 306 of plunger 301 is normally biased against a shoulder 343 of valve assembly 40 and forms a selectively openable outlet to flow path 41**.

Plunger 301 (shown in FIG. 3) includes a head 306 and a shaft 305. Shaft 305 includes an engagement portion 307 which engages pivot arm 47. A helical biasing spring 345 extends between head 306 of plunger 301 and a bearing washer 347. Helical biasing spring 345 normally biases head 306 of plunger 301 against shoulder 343 due to the force exerted between bearing washer 347 pushing against bearing member 347A and the ledge 309 of head 306. As a result, plunger 301 is normally biased in a direction opposite to arrow D of FIG. 3 and fluid does not pass through the fluid impervious wall formed by head 306 of plunger 301 and shoulder 343. This is because plunger 301 bears against shoulder 343 and blocks off discharge end 42 of valve assembly 40.

Shaft 305 of plunger 301 passes through a bore 351 in valve assembly 40 in order to allow shoulder 305A to be coupled to corresponding surface 307 of pivot arm 47. A gasket pair 353A is seated within counterbore 351A in order to create a fluid tight seal between counterbore 351A and shaft 305. Bearing 351 maintains the radial alignment of shaft 305 relative to valve body 40.

When pivot arm 47 is activated, as described hereinbelow, by a user squeezing trigger assembly 50, pivot arm 47 of valve assembly 40 moves in a direction of arrow D in FIG. 3. Pivot arm 47 is coupled to shoulder 307 and causes same to move in the direction of arrow D. Shoulder 307 causes shaft 305 of plunger 301 to move in the direction of arrow D. Accordingly, head 306 of plunger 301 moves in the direction of arrow D and breaks the seal between head 306 and shoulder 3.43. As a result, fluid exits discharge end 42 of valve assembly 40.

Figure 4:
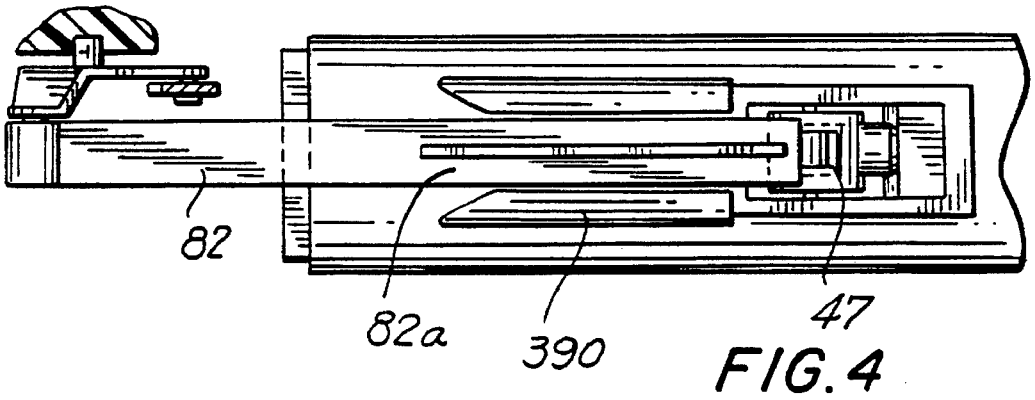
FIG. 4 is a fragmentary cross-sectional view taken along line 4—4 of FIG. 3 which illustrates the push rod engaging the valve assembly.

With reference to FIG. 4, valve assembly 40 includes a pair of axially extending walls 390 disposed on either side of pivot arm 47. Walls 390 form a track to receive elongated body 82a of push link 82 of trigger assembly 50 which is discussed in more detail below. The track maintains push link 82 in contact with pivot arm 47. Furthermore, housing 100 is formed with extrusions (not shown), that engage walls 390 when valve assembly 40 is inserted and removed from housing 100. Accordingly, push link 82 is substantially confined within the track formed by walls 390. However, push link 82 is freely slidable in the axial direction.

With particular reference to FIG. 2, fluid flows through valve assembly 40 into flow tube 46 which is essentially a curved conduit. A fuel check valve 21 and gasket 23 are housed within flow tube 46 proximate to its intersection with spout 28. Spout 28 is preferably formed by extrusion from a tubular pipe member and comprises an outer cylindrical member and an inner concentrically disposed cylindrical member. The outer cylindrical member and the inner cylindrical member are connected together by a series of longitudinally and continually extending ribs which define a plurality of continually extending channels (not shown).

Spout 28 includes bores 107 proximate to dispensing end 27 and bores 109 proximate receiving end 64. Each set of bores 107 and 109 pass through outer member 102, but not inner member 103. These bores are provided for the vapor recovery aspects of the fuel dispensing nozzle.

In order to obtain fluid flow, trigger assembly 50, which is received within saddle 90 of housing 100, activates pivot arm 47 of valve assembly 40.

Figure 5:
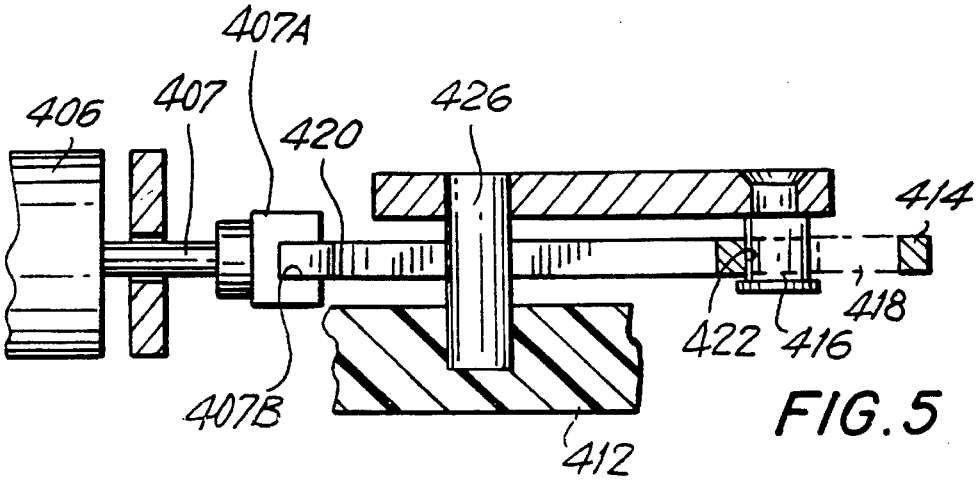
FIG. 5 is a fragmentary cross-sectional view along line 5—5 of FIG. 3 which illustrates the solenoid engaging the slip link.

Reference is now made to FIGS. 3 and 5 which generally illustrate the trigger assembly. The trigger assembly is an electromechanical system; the electronic component is made up of a circuit board 212 (shown in greater detail in FIG. 2) which includes a mercury switch 400 and a pressure switch 402 which are capable of inhibiting the trigger assembly. Circuit board 212 also includes a solenoid 406 which is an electromechanical transducer.

Trigger assembly 50 includes a bellcrank 410 having a pin 424 that snap fits into push link 82. Pivot boss 412 is formed within housing 100 and receives bellcrank 410 and push link 82 therein. Slip link 414 snaps on trigger 412A at pivot 412B and receives pin 416 of bellcrank 410 within channel 418. Furthermore, in the preferred embodiment, slip link 414 is formed with an extended finger 420 for engaging groove 407B of head 407A which is press fit onto solenoid push bar 407. A biasing spring 421 is provided at the pivot point 426 of trigger 412A to normally bias trigger 412A in the direction of arrow E.

Particular reference is now made to FIG. 3, which illustrates nozzle assembly 24 with electrical current running therethrough in the uninhibited condition and the trigger assembly 50 inactivated. In particular, solenoid 406 is activated, such that solenoid push bar 407 is extended in the direction of arrow D. Push bar 407 bears against finger 420 of slip link 414. This causes pin 416 of bellcrank 410 to sit on and be held by ramp surface 422 (shown in FIG. 5) of slip link 414.

Trigger 412A is not activated. It is biased in the direction of arrow E by biasing spring 421. Thus, pin 424 of bellcrank 410 is seated at its at-rest position proximate to pivot point 426 of pivot boss 412a. Accordingly, elongated body 82a of push link 82 does not exert force on pivot arm 47 of valve assembly 40.

Therefore, pivot arm 47 of valve assembly 40 is displaced in a direction opposite to arrow D. Head 300 of plunger 301 is biased against shoulder 343 in the direction opposed to arrow D by helical biasing spring 345, such that no fluid flows through valve assembly 40.

Figure 6:
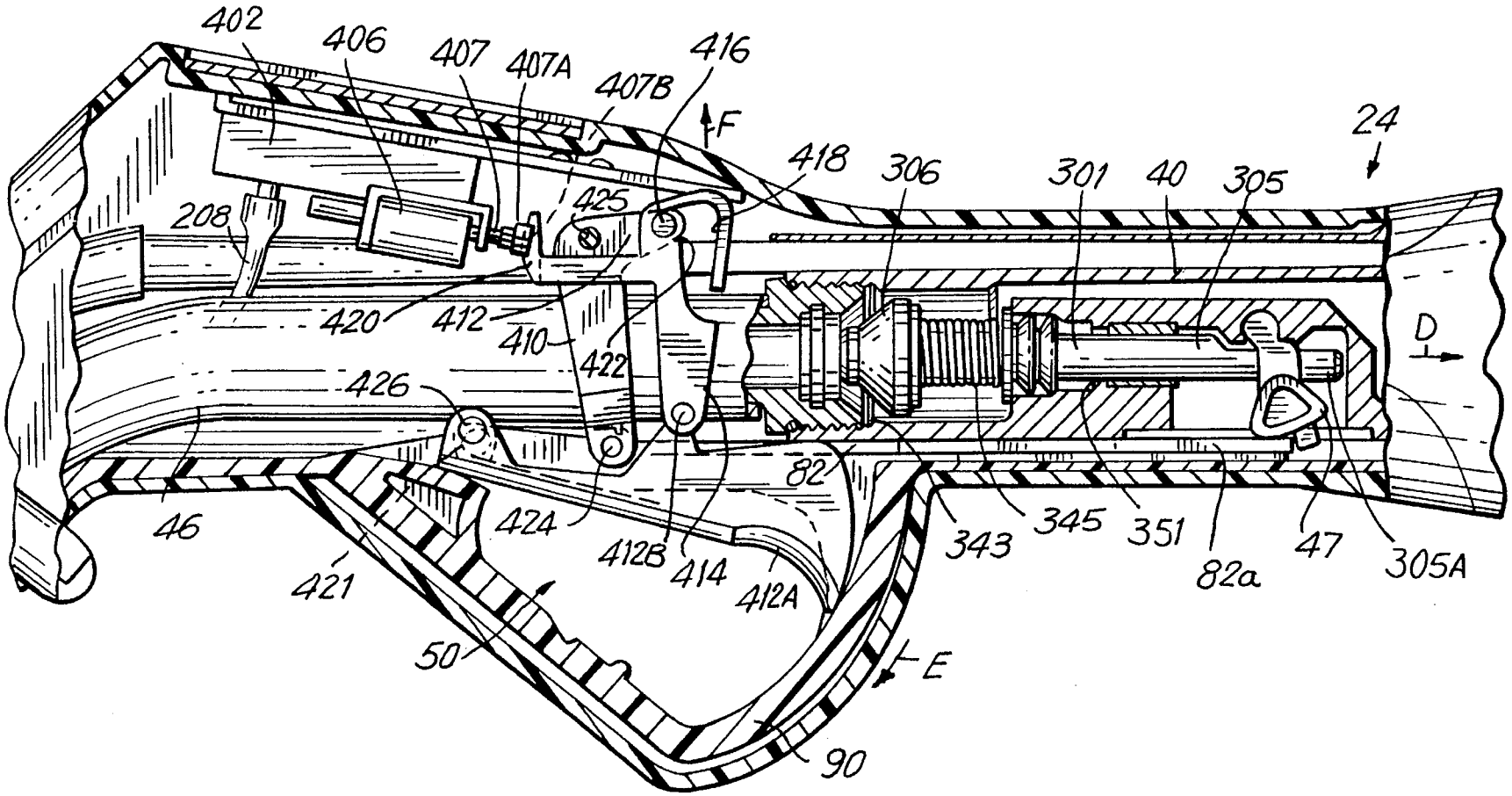
FIG. 6 is a fragmentary elevational view of a fuel dispensing nozzle assembly with the housing cut away and the trigger activated.

Reference is now made to FIG. 6, which illustrates dispensing nozzle 24 while fuel is dispensed. Solenoid 406 is activated, such that solenoid push bar 407 is extended in the direction of arrow D. Push bar 407 bears against finger 420 of slip link 414 and causes pin 416 of bellcrank 410 to sit on ramp surface 422 of slip link 414.

Trigger 412 is activated by a user biasing it in the direction opposite to arrow E. Therefore, pin 416 of bellcrank 410 is biased in the direction of arrow F by ramp surface 422 of slip link 414. In other words, when the operator pulls the trigger 412, slip link 414 is lifted and the movement of slip link 414 is transferred to bellcrank 410. Bellcrank 410 pivots about pin 426 and causes pin 424 and push link 82 to move in the direction of arrow D.

Therefore, elongated body 82a of push link 82 bears against pivot arm 47 of valve 40. This causes head 306 of plunger 301 to move in the direction of arrow D and away from shoulder 343. Accordingly, fluid can flow through valve 40 and out of nozzle assembly 24.

Figure 7:
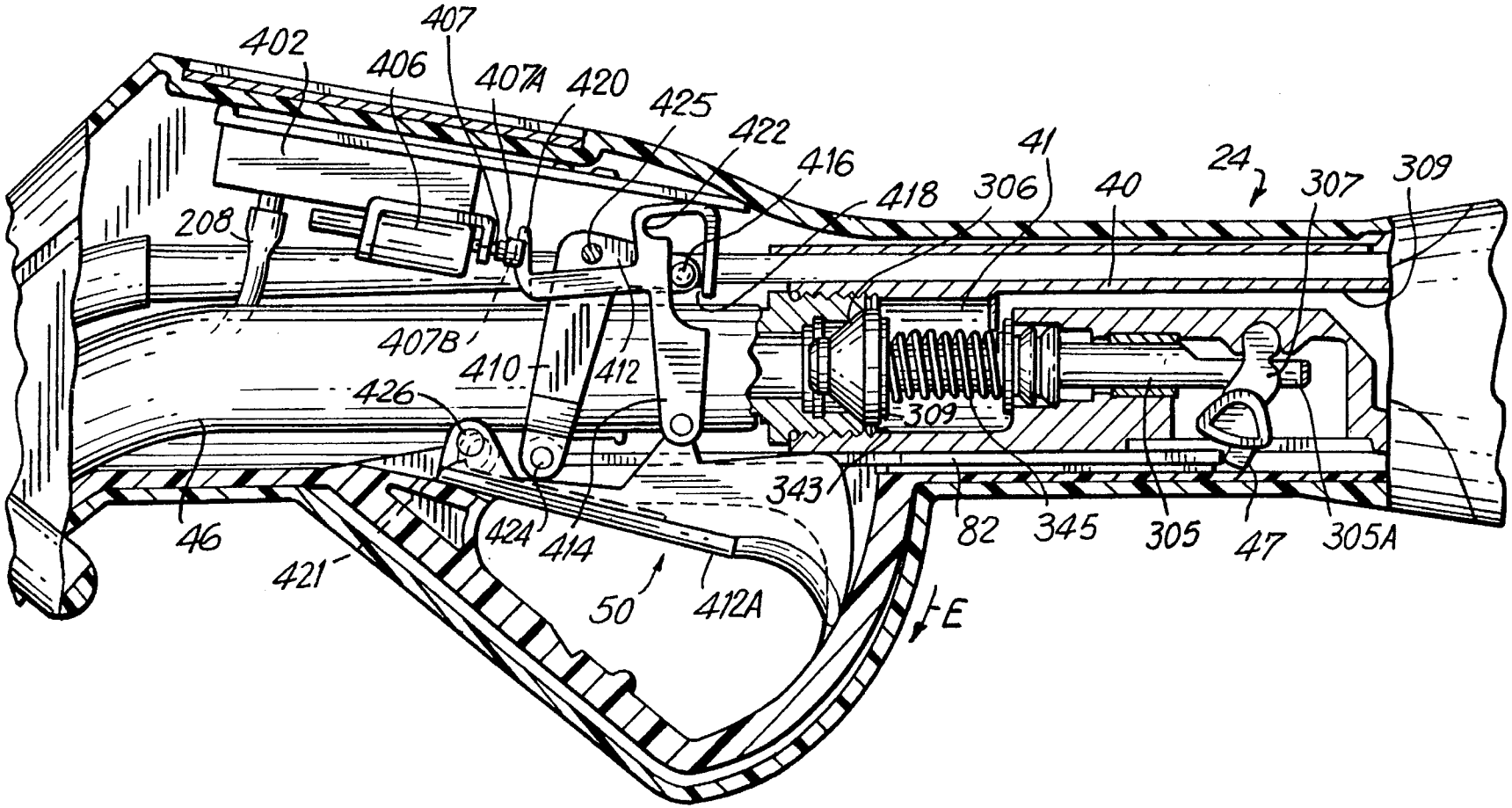
FIG. 7 is a fragmentary elevational view of a fuel dispensing nozzle assembly with the housing cut away, the trigger activated and the solenoid inhibited.

Particular reference is next made to FIG. 7, which illustrates fuel dispensing nozzle 24 with the electronic elements inhibited and trigger assembly 50 activated by a user compressing trigger 412A in the direction opposite to arrow E. The electronic component could be inhibited for one of three major reasons listed here and described in great detail hereinafter. Firstly, the fuel tank may be full and pressure sensor 402 may inhibit fuel dispensation. Secondly, fuel dispensing nozzle 24 may be at an improper angle for fuel dispensation, so that mercury switch 400 (shown in FIG. 2) may be off. Thirdly, the power may not be received by the nozzle assembly - the fuel pump may not be properly recycled after previous use.

FIG. 7 depicts nozzle assembly 24 with the electronics in an inhibited state. Accordingly, solenoid 406 is not activated and solenoid push bar 407 is not extended in the direction of arrow D. Therefore, push bar 407 does not bear against finger 420 of slip link 414. Pin 416 of bellcrank 410 is not held on ramp surface 422 and instead slips off ramp surface 422 of slip link 414 and into groove 418 of slip link 414.

When trigger boss 412 is activated by a user biasing it in the direction opposite to arrow E, pin 416 of bellcrank 410 slips into groove 418 of slip link 414. Accordingly, trigger boss 412 transmits motion to slip link 414, but slip link 414 does not transmit the motion to bellcrank 410. Bellcrank 410 does not pivot about pin 426 and does not move push link 82.

Accordingly, push link 82 does not bear against pivot arm 47 of valve 40, and valve 40 is not activated, and fuel does not flow through nozzle assembly 24.

Figure 8:
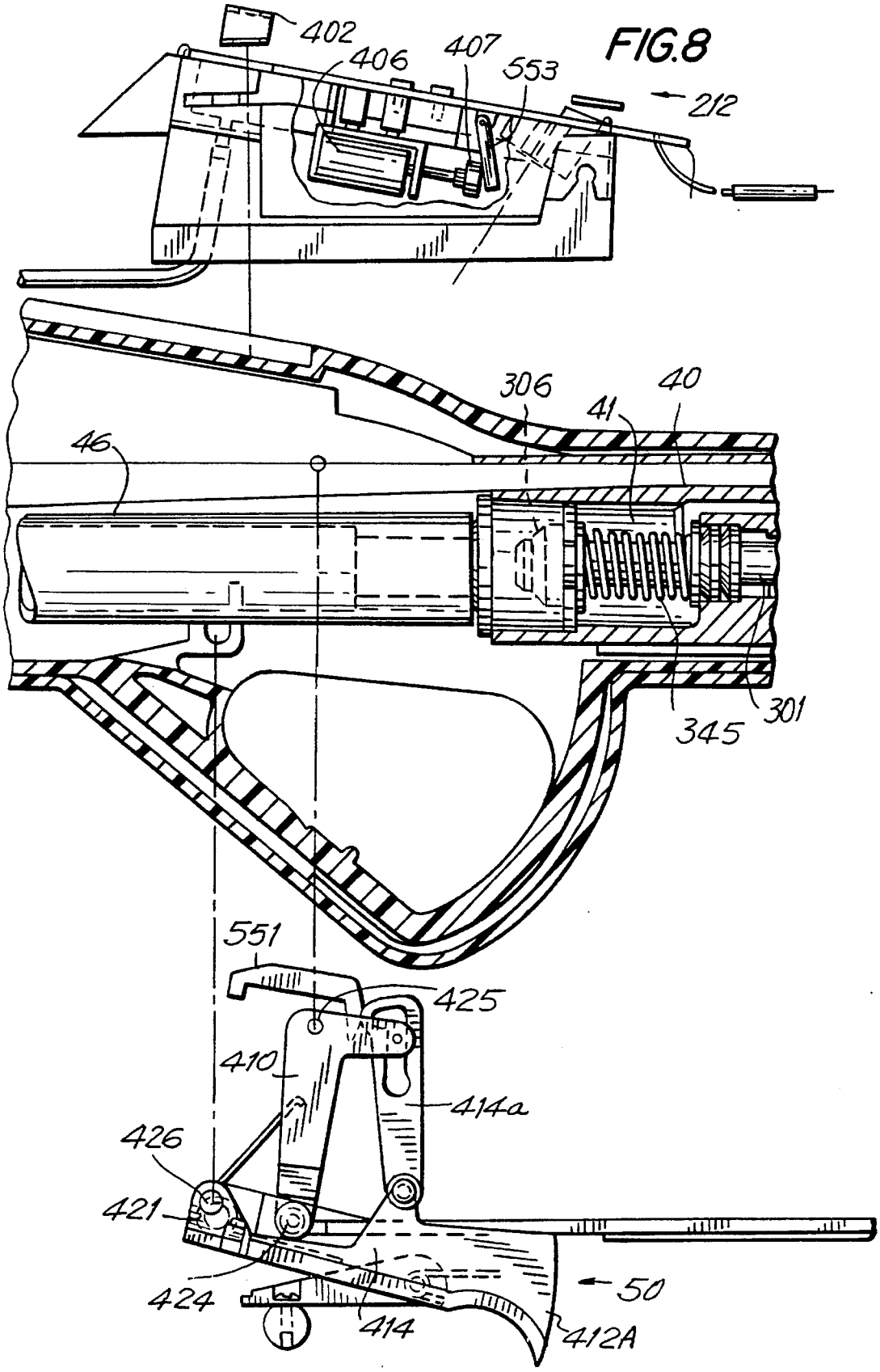
FIG. 8 is an exploded fragmentary cross-sectional view of a fuel dispensing nozzle formed in accordance with a second embodiment of the invention.

Particular reference is next made to FIG. 8, which illustrates a second embodiment of the invention, wherein like reference numerals are used to represent like elements. FIG. 8 is an exploded fragmentary cross-section of the second embodiment of the invention, and the portions not shown are identical to those of the first embodiment.

In particular, the embodiment of FIG. 8 varies from the first embodiment in the construction of slip link 414*a*, which does not include a finger 420 as does slip link 414 of the first embodiment. Furthermore, a solenoid push bar 551 is required to transmit the linear motion from solenoid flapper 553, to slip link 414*a*.

The embodiment of FIG. 8 functions substantially identically to that of the first embodiment. The nozzle assembly includes a circuit board 212a which is substantially identical to circuit board 212 except for the positioning of solenoid 406 and the inclusion of solenoid flapper 553. Solenoid flapper 553 provides a larger surface area for contacting solenoid push bar 551 and also helps to reduce the load on solenoid 406 in order to operate the nozzle assembly as described above.

During operation, solenoid 406 is activated when pressure switch 402 and the mercury switch are not inhibited. This causes solenoid push bar 407 to extend. Solenoid push bar 407 bears against solenoid flapper 553. Solenoid flapper bears against linkage 501 which in turn bears against slip link 414*a* and cause same to engage bellcrank 410 as described above. Alternatively, if solenoid 406 is not activated, slip link 414*a* does not engage bellcrank 410. The remaining operations of the second embodiment are substantially identical to those of the first embodiment and are described hereinabove in detail.

Figure 9:
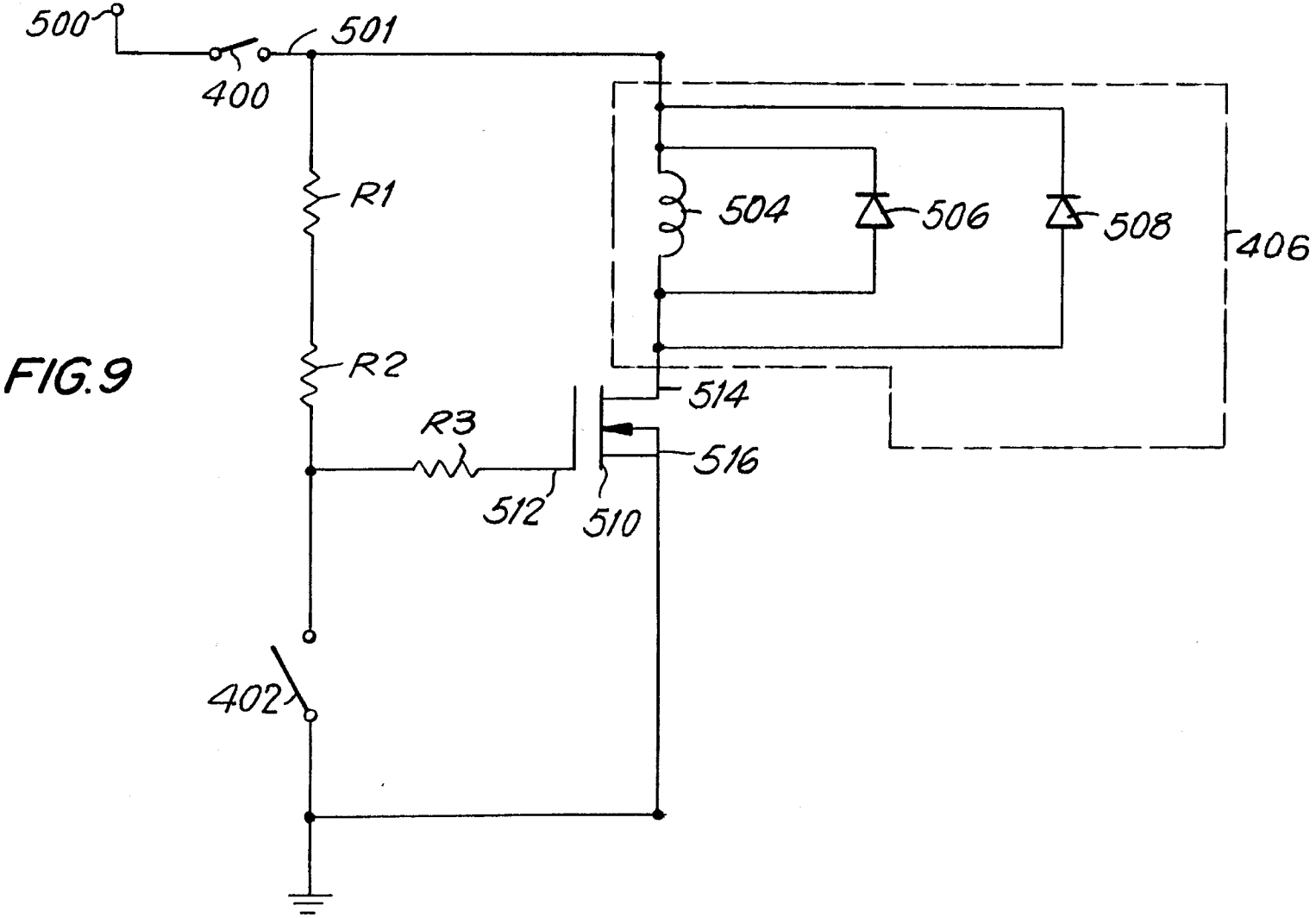
FIG. 9 is a schematic representation of the electronic components of the trigger assembly.

Particular reference is now made to FIG. 9, which is a schematic representation of the pertinent electric circuitry located on circuit board 212. Power or electric potential is received at lead 500 which is electrically connected to switch S1. The second side 501 of switch S1 is electrically connected to resistor R1 which is in series with resistor R2. Resistor R2 is electrically connected to switch S2, which is in turn electrically connected to ground, and resistor R2 is also electrically connected to resistor R3 which is electrically connected to the gate 512 of field effect transistor (FET) 510.

The second side 501 of switch S1 is also electrically connected to one side of solenoid 502. The other side of solenoid 502 is electrically connected to drain 514 of FET 510. Source 516 of FET 510 is connected to ground.

Switch S1 is preferably a mercury switch which is used to inhibit the circuitry. Accordingly, switch S1 is mounted on circuit board 212 in such a way that the switch is closed when nozzle assembly 24 is in a normal fluid dispensing position. Alternatively, when the nozzle assembly is held in a vertical position during return to the boot or while seated in the boot, switch S1 is open and the circuit is inhibited.

Resistors R1 and R2 are connected in series and supply a current limiting function because switch S2 is a pressure switch that can only handle a few milliamps. Accordingly, resistors R1 and R2 protect switch 2. Switch S2 opens and closes according to increased fuel pressure, or in other words, a rise in the fluid level in the fuel tank. When switch S2 is open the voltage at gate 512 increases and current flows from drain 514 to source 516 of FET 510. In other words, current flows through solenoid 502 and solenoid push bar 407 of FIG. 3 is extended. Alternatively, when switch S2 is closed due to pressure in the gas tank, the voltage at gate 512 is decreased and no current flows from drain 514 to source 516 of FET 510. Therefore, solenoid 502 is inactive and push bar 407 of FIGS. 3, 6 and 7 is not extended.

Solenoid 502 is an inductive coil 504 in parallel with diodes 506 and 508. Diodes 506 and 508 are surge preventing diodes which are in parallel in case either diode open circuits. Accordingly, when either S1 or FET 510 open, the inductor will not create a negative-going spike sufficient to cause a spark that could ignite fuel vapors from the dispensation process.

The foregoing construction uses two inhibit switches S1 and S2 which can each terminate fuel flow. Furthermore, once the pressure exceeds the predesigned switch pressure, no more fuel is dispensed. The user cannot spit gas into the fuel tank as is done with conventional fuel dispensing nozzles of a purely mechanical nature.

It will thus be seen that the objects set forth above, among those made apparent from the preceding description are efficiently obtained, and since certain changes may be made in the above construction without departing from the spirit and scope of the .invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic fuel dispensing nozzle assembly for dispensing fuel into a fuel tank, comprising;

a nozzle housing;

a valve located within said housing, said valve being selectively displaceable between an open position and a closed position;

a trigger assembly including a trigger boss, a slip link and a bellcrank selectively displaceable between a first position and a second position; and electronic means disposed within said housing for selectively enabling said trigger assembly to selectively open said valve when said trigger boss is displaced from said first position to said second position, said electronic means including a solenoid for providing mechanical enablement of said trigger assembly and further including at least one diode back biasing said solenoid.

2. The electronic fuel dispensing nozzle of claim 1, wherein said electronic means includes a mercury switch for selectively inhibiting said solenoid.

3. The electronic fuel dispensing nozzle of claim 2, wherein said mercury switch inhibits said solenoid when said dispensing nozzle is not in the appropriate position for fuel dispensation.

4. The electronic fuel dispensing nozzle of claim 1, wherein said electronic means includes a pressure switch for selectively inhibiting said solenoid.

5. The electronic fuel dispensing nozzle of claim 4, wherein said pressure switch inhibits said solenoid when pressure in said pressure switch rises due to the fluid being dispensed rising above a sentry point in the nozzle assembly.

6. An electronic fuel dispensing nozzle assembly for dispensing fuel into a fuel tank, comprising:

a nozzle housing;

a valve located within said housing, said valve being selectively displaceable between an open position and a closed position;

a trigger assembly including a trigger boss, a slip link and a bellcrank selectively displaceable between a first position and a second position; and electronic means disposed within said housing for selectively enabling said trigger assembly to selectively open said valve when said trigger boss is displaced from said first position to said second position, said electronic means including a solenoid for providing mechanical enablement of said trigger assembly and a transistor for selectively enabling current to flow through said solenoid.

7. The electronic fuel dispensing nozzle assembly of claim 6, wherein said slip link is coupled to said trigger boss, and said bellcrank is selectively engaged by said slip link.

8. The electronic fuel dispensing assembly of claim 7, wherein said slip link includes a ramp surface and said bellcrank includes a pin, and said solenoid selectively applies pressure to said slip link such that said pin is held by said ramp surface of said slip link.

9. The electronic fuel dispensing nozzle assembly of claim 8, wherein said ramp surface of said slip link engages said pin of said bellcrank when said solenoid applies pressure to said slip link.

10. An electronic fuel dispensing nozzle assembly for dispensing fuel into a fuel tank, comprising:

a nozzle housing;

a valve located within said housing, said valve being selectively displaceable between an open position and a closed position;

a trigger assembly including a trigger boss, a slip link and a bellcrank selectively displaceable between a first position and a second position;

electronic means disposed within said housing for selectively enabling said trigger assembly to selectively open said valve when said trigger boss is displaced from said first position to said second position;

said slip link being coupled to said trigger boss, and said bellcrank being selectively engaged by said slip link, and further including a push rod coupled to said bellcrank for selectively opening said valve.

11. The electronic fuel dispensing nozzle assembly of claim 10, wherein said electronic enabling means includes a solenoid for providing mechanical enablement of said trigger assembly, and at least one switch for selectively inhibiting said solenoid.

12. The electronic fuel dispensing nozzle assembly of claim 11, wherein said at least one switch inhibits said solenoid once its fuel dispensing nozzle is not in the appropriate position for fuel dispensation.

13. The electronic fuel dispensing nozzle assembly of claim 12, wherein said at least one switch is a mercury switch.

14. The electronic fuel dispensing nozzle assembly of claim 13, wherein said at least one switch inhibits said solenoid when a fuel tank being filled reaches a predetermined fill level.

15. The electronic fuel dispensing nozzle assembly of claim 14, wherein said at least one switch is a presser switch.

16. An electronic fuel dispensing nozzle assembly for dispensing fuel into a fuel tank, comprising:

a nozzle housing;

a valve located within said housing, said valve being selectively displaceable between an open position an a closed position;

a trigger assembly including a trigger boss, a slip link and a bellcrank selectively displaceable between a first position and a second position, said slip link being coupled to said trigger boss, and said bellcrank being selectively engaged by said slip link;

electronic means disposed within said housing for selectively enabling said trigger assembly to selectively open said valve when said trigger boss is displaced from said first position to said second position, said electronic means including solenoid means for providing mechanical enablement of the trigger assembly;

wherein said slip link includes a ramp surface and said bellcrank includes a pin, and said solenoid means selectively applies pressure to said slip link, so that said ramp surface of said slip link engages said pin of said bellcrank when said solenoid applies pressure to said slip link; and wherein said bellcrank is coupled to a push rod for selectively engaging said valve when said solenoid applies pressure to said slip link.

* * * * *